United States Patent [19]

Cameron

[11] Patent Number: 4,850,064

[45] Date of Patent: Jul. 25, 1989

[54] PORTABLE TOILET WITH VENT FOR FLUSH WATER SUPPLY TANK

[75] Inventor: David B. Cameron, Milford, Mich.

[73] Assignee: Thetford Corporation, Ann Arbor, Mich.

[21] Appl. No.: 118,561

[22] Filed: Nov. 9, 1987

[51] Int. Cl.[4] ..... E03D 1/00; B65D 51/16

[52] U.S. Cl. ..... 4/321; 4/323; 220/373

[58] Field of Search ..... 4/323, 460, 322, 459, 4/449, 300, 317–322, 329, 347, 353, 417, 321; 220/374, 373, 367–369, 293, 297, 298, 300–302

[56] References Cited

U.S. PATENT DOCUMENTS

| | | | |
|---|---|---|---|
| 892,716 | 7/1907 | Ellery | 220/374 |
| 2,337,046 | 12/1943 | Howard | 220/373 |
| 2,721,000 | 10/1955 | Schwendler et al. | 220/374 |
| 3,140,794 | 7/1964 | Arndt et al. | 220/374 |
| 3,351,497 | 11/1967 | Lucas | 220/373 |
| 3,801,991 | 4/1974 | Fulton et al. | 4/323 |
| 4,145,773 | 3/1979 | Sargent et al. | 4/321 |
| 4,180,876 | 1/1980 | Sargent et al. | 4/323 |
| 4,215,445 | 8/1980 | Antos et al. | 4/323 |
| 4,217,668 | 8/1980 | Sargent et al. | 4/323 |
| 4,285,440 | 8/1981 | Adams | 220/374 |
| 4,460,101 | 7/1984 | Tseng | 220/374 |
| 4,641,383 | 2/1987 | Sargent et al. | 4/321 |
| 4,666,058 | 5/1987 | Harris | 220/373 |

FOREIGN PATENT DOCUMENTS

| | | | |
|---|---|---|---|
| 1157207 | 11/1983 | Canada | 4/321 |

*Primary Examiner*—Thomas R. Hannon

*Attorney, Agent, or Firm*—Harness, Dickey & Pierce

[57] ABSTRACT

A portable toilet having a fill cap covering the fill opening for a flush water tank. The cap includes a lid with an air vent opening and a seal member captivated in a cage extending downwardly from the lid into the tank, the cap being removably mounted on a tube for filling the tank with water. An air path from the atmosphere to tank is defined by the lid vent opening and an annulus around the seal. The cage is inserted into the tube and should the water splash in the tube the seal is forced upwardly and against the vent opening to prevent water from escaping.

4 Claims, 1 Drawing Sheet

PORTABLE TOILET WITH VENT FOR FLUSH WATER SUPPLY TANK

BACKGROUND AND SUMMARY OF THE INVENTION

This invention relates to portable toilets and is particularly concerned with a vent arrangement for the flush water storage tank that allows air into the tank to replace water removed from flushing but which also prevents water leakage through the vent in case of splashing of water in the tank or overturning of the toilet.

A number of commonly assigned patents disclose portable toilets of the type which comprises a holding tank section and a seat section separably mounted on the holding tank section. The seat section comprises a bowl with a bottom outlet which registers with an opening in the top wall of the holding tank. When the two sections are mounted together the bowl outlet is in sealed relationship with the opening in the top wall of the holding tank. A valve in the holding tank is disposed at the opening and when the valve is opened the contents of the bowl drop into the holding tank whereby the accumulated contents may be dumped from time to time at suitable sanitary disposable stations.

The seat section has a hollow wall structure serving as a water storage compartment for flushing purposes with the rear of the section including a fill port for filling the compartment and a pump such as a manually operable bellows for flushing the bowl. The pump operates on a pressure differential in that downward movement discharges flush water from the tank onto the bowl and upward movement lowers the pressure to draw water upwardly from the tank. Thus withdrawal of water from the flush tank for flushing purposes requires adequate air venting of the tank so that each water withdrawal can be replaced by air. However, it is also desirable to prevent leakage of water from the tank through the air vent when the toilet is overturned or when water in the tank is splashing due to movement of the toilet.

In accord with this invention, a vent opening is provided in the cap for the fill opening so that atmospheric air can at all times flow freely into the interior of the storage tank during flushing. A vent chamber is formed integrally with the fill cap at a position within the tank. A seal member is arranged within the vent chamber so that if the toilet is tilted or moved so that flush water in the tank is caused to splash or if the toilet is inadvertently overturned water from the flush tank will not spill outwardly through the vent opening because the seal will be moved by water in the tank to cover the vent opening. Otherwise air can freely pass between the atmosphere and the tank interior, to provide a continuous vent for flushing, thermal expansion, altitude changes, etc.

The foregoing features, advantages and benefits of the invention along with additional ones, will be seen in the ensuing description and claims which should be considered in conjunction with the accompanying drawings.

The drawings disclose a preferred embodiment of the invention according to the best mode contemplated at the present time in carrying out the invention.

DESCRIPTION OF THE PREFERRED EMBODIMENT

Figure 1:
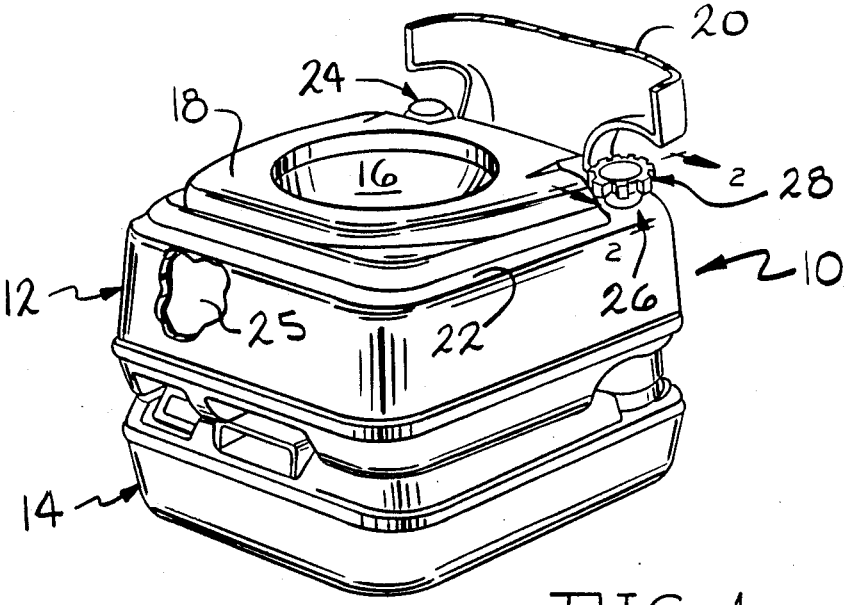
FIG. 1 is perspective view of a portable toilet of the present invention having a portion broken away from purposes of clarity.

The portable toilet of this invention, indicated generally at 10 is shown in FIG. 1 as comprising a seat section 12 which separably mounts on a holding tank section 14 in a conventional manner. Details of the toilet construction can be best seen in "Portable Toilets" U.S. Pat. No. 4,180,876 issuing Jan. 1, 1982 to Sargent et al, specifically incorporated herein by reference.

FIG. 1 shows the toilet when the two sections are connected together. The seat section 12 comprises a bowl 16, an overlying seat 18, and a cover 20 hingedly mounted to the section 12. The bowl 16 has a bottom outlet (not viewable) which overlies an inlet opening to holding tank 14, the opening being closed by a slide valve mounted within the interior of the holding tank. When the slide valve is opened the contents of bowl 16 drop into the holding tank. In this way holding tank 14 accumulates waste contents for later disposal at a suitable sanitary disposal station.

A flush water storage chamber or tank 25 provided within the interior of seat section 12 is filled with fresh water via a fill tube 26 the end of which extends upwardly from the top wall 22 to be closed by a removable fill cap 28. A pumping mechanism 24 is provided for pumping flush water from the water storage chamber 25 into bowl 16.

In order to promote a reasonably smooth flow of the flush water out of tank 25 and into the bowl 16 it is necessary to provide an opening for directly venting the head space of the flush water storage tank to atmosphere during the flushing operation by the pump mechanism. Venting enables air to enter tank 25 to replace the water removed by pump 24.

Figure 2:
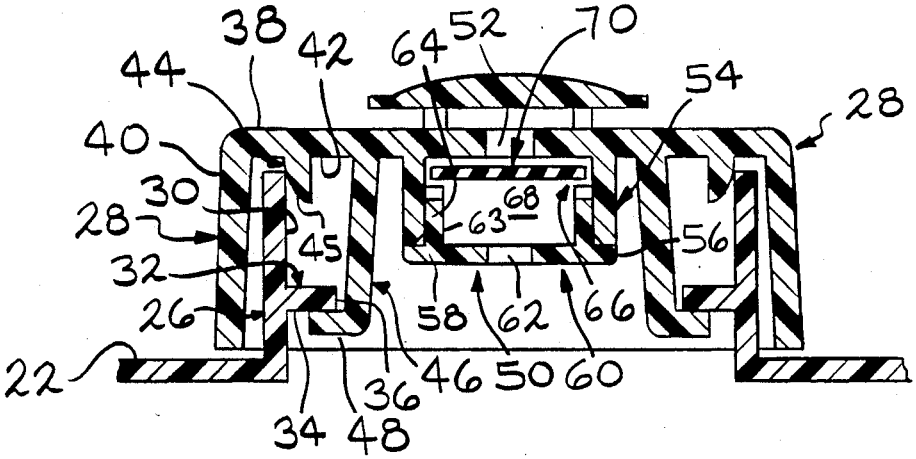
FIG. 2 is an enlarged sectional view of the vent structure of this invention in the fill cap as seen from substantially the line 2—2 in FIG. 1.
Figure 3:
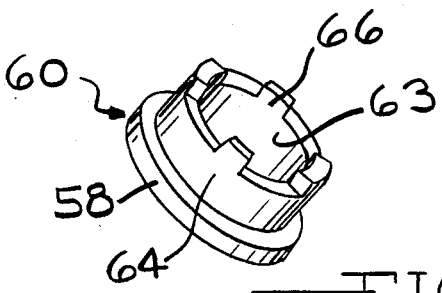
FIG. 3 is a perspective view of a portion of the vent structure shown in FIG. 2.

FIGS. 2 and 3 show the cylindrical fill cap 28 removably interlocked in a breech lock manner in an end portion of the fill tube 26 extending from the top wall 22 of the seat section. The fill tube is generally cylindrical and includes an inner wall 30, and an annular flange 32 extending radially inward from the inner wall. The annular flange 32 has a bottom face 34 facing inwardly of the tank and a plurality of angularly spaced cutouts or keyways (not shown) each keyway extending radially outward from the inner edge 36 of the flange.

The cap 28 includes a flat circular lid 38 having a center aperture 52 and an annular skirt 40 connected 360° about the lid and extending coaxially about the tube and downwardly to the top wall. Interconnected with the bottom surface 42 of the lid are an outer boss or flange 44 and an inner tubular boss 54, the bosses being coaxially disposed with the outer boss having a tapered portion 45 facing the inner wall of the skirt to frictionally engage interior wall 30 of fill tube 26. Preferably, the boss 44 would form a continuous cylindrical sleeve whereby portion 45 would form a 360° frictional engagement around interior wall 30. A pair of lock members 46 extend downwardly from the cap each terminating in a radially outwardly extending foot 48, each foot being angularly positioned to register with and fit between a respective keyway such that downward insertion and rotation of the cap simultaneously causes the tapered surfaces 46 to frictionally drive against the inner wall of the tube and the feet to engage the bottom face 34 of the annular flange.

A cage assembly 50 extends downwardly from the lid when the cap 28 is secured to the tube 26, the cage including the cylindrical boss 54 having an annular end face 56, and a seal support or cap member 60 connected to the boss. The cap member 60 and central boss 54 describe a closed cylindrical chamber 68 to receive a seal 70 formed of rubber or the like and engagable with the lid 38 so as to cover the vent 52.

The cap member 60 has a flat circular base 58 having a central aperture 62 and a cylindrical sleeve 64 extending upwardly from the base, the sleeve ending in a vertically slotted annular shoulder to provide a plurality of angularly spaced posts 66, the outer diameter of said sleeve 64 being defined by a diameter slightly greater than the inner diameter of the central boss 54 to frictionally interfit therewithin. The base extends concentrically around the sleeve and is adapted to engage the inward annular end face 56 of boss 54 to limit upward insertion of the cap member.

The seal 70 is planar, generally cylindrical and has a diameter slightly less than the diameter defining the interior wall 63 of sleeve 64 such that an annular gap exists between the seal and the sleeve. In the chamber the seal 70 sits on the top of the posts 66 extending from the top end of sleeve 64.

FIG. 3 shows the cap member 60 to be frictionally inserted within the bore of center boss 54 to form the cage. The base extends concentrically around the cylindrical sleeve 64 and four angularly spaced posts 66 rise from the end of the sleeve.

In operation, the cap member 60 is received in the center bore 54 to form the chamber 68 captivating the seal 70. Should the tank 25 be inverted or subjected to abrupt and sudden movement causing splashing of water in the tank 25, the water in the tank will move the seal 70 from its position on top of the posts 66 to a position against the bottom surface of the lid whereby the center aperture 52 in the cap is closed and no water will escape. In ordinary application, an air path is defined through the center aperture 52 in the cap and into the chamber, around the circumference of the seal and through the vertical slots angularly spacing the posts, and through the aperture 62 in the cap member 60. This air path enables air to enter the tank 25 during water flush operations.

While the above description constitutes the preferred embodiment, it will be appreciated that the present invention is susceptible to modification and change without departing from the fair meaning or proper scope of the accompanying claims. For example, the cage and seal may be other than cylindrical, the cap member could be secured other than by frictional forces cooperating, and the cage could be integral and adapted to be mounted to the lid in which case the downward central boss could be unnecessary.

What is claimed is:

1. In a portable toilet having a storage tank for flush water, a removable cap mounted on the top side of said tank, means forming a vent opening in said cap enabling passage of exterior air to the interior of said tank, a sealing member for sealing said vent opening, and means movably mounting said sealing member on said cap in communication with the interior of said tank so that water splashing in said tank can move said sealing member into a position closing said vent opening, said means mounting said sealing member comprising cage means extending downwardly from said cap defining a chamber for captivating said sealing member, said sealing member being adapted to move into engagement with said cap at a position closing said vent opening as a result of hydrostatic pressure upon one side of said seal member when said tank is inverted.

2. The invention as recited in claim 1 wherein said sealing member is of flat circular shape, and said cage means includes means for supporting the periphery of the sealing member and providing for flow of air around the periphery of said sealing member.

3. The invention as recited in claim 2 wherein said cap includes a head and integrally formed locking means extending downwardly from the head for releasing locking said cap to said tank, and a seal support member inserted within said cage, said support member having a flat centrally apertured circular base and a cylindrical sidewall extending upwardly from said base and being adapted to frictionally fit interiorly of the cage and form said means for supporting said sealing member.

4. In combination a portable toilet having a seat section including a flush water tank separably mounted on a holding tank section, fill means including a fill cap removably mounted on a fill tube for filling the water tank, and flush means for flushing the contents from the seat section into the holding tank, the improvement characterized by vent means operatively associated with said fill means for communicating air from atmosphere to the flush water compartment, said vent means comprising means forming an air passage in said fill cap extending therethrough to pass air into the storage tank and a sealing member disposed in said fill tube for movement to a position closing said air passage, and cage means on said cap captivating said seal for vertical movement therewithin, said cage means being insertable into said fill tube when the cap is removably mounted to said tube, movement of the seal when acted on by water in the tank closing the air passage in said cap.

* * * * *